US007942753B2

(12) United States Patent
Raredon et al.

(10) Patent No.: US 7,942,753 B2
(45) Date of Patent: May 17, 2011

(54) PLAY APPARATUS WITH INTEGRATED SOUND PRODUCING MECHANISM

(76) Inventors: Thomas L. Raredon, Florence, MA (US); Chuck Olson, Becker, MN (US)

( * ) Notice: Subject to any disclaimer, the term of this patent is extended or adjusted under 35 U.S.C. 154(b) by 142 days.

(21) Appl. No.: 12/235,587

(22) Filed: Sep. 22, 2008

(65) Prior Publication Data

US 2009/0081922 A1 Mar. 26, 2009

Related U.S. Application Data

(60) Provisional application No. 60/974,442, filed on Sep. 21, 2007.

(51) Int. Cl.
*A63G 9/02* (2006.01)
*A63G 13/00* (2006.01)

(52) U.S. Cl. ..... 472/118; 472/98; 446/397

(58) Field of Classification Search ..... 472/98, 472/106–115, 118–125; 446/188, 397
See application file for complete search history.

(56) References Cited

U.S. PATENT DOCUMENTS

| | | | | |
|---|---|---|---|---|
| 1,550,040 | A | | 8/1925 | Nagy |
| 2,398,122 | A | | 2/1945 | Souza |
| 2,461,588 | A | | 2/1949 | Cooper |
| 2,527,763 | A | | 10/1950 | Probst |
| 2,784,968 | A | | 3/1957 | Bakula |
| 2,851,271 | A | | 9/1958 | Suter |
| 4,844,447 | A | | 7/1989 | McKnight |
| 5,074,820 | A | * | 12/1991 | Nakayama ..... 446/29 |
| 5,217,411 | A | | 6/1993 | Spector et al. |
| 5,421,763 | A | | 6/1995 | Amburgey et al. |
| 5,660,430 | A | | 8/1997 | Clarke |
| 6,093,428 | A | | 7/2000 | Hoeting et al. |
| 6,416,381 | B1 | * | 7/2002 | Walter et al. ..... 446/397 |
| 6,482,096 | B1 | | 11/2002 | Rieber et al. |
| 6,705,950 | B2 | | 3/2004 | Wood et al. |
| 6,991,549 | B2 | | 1/2006 | Ballin |
| 7,419,436 | B2 | | 9/2008 | Ballin |
| 2001/0029206 | A1 | | 10/2001 | Henry |
| 2008/0287035 | A1 | | 11/2008 | Ballin |

FOREIGN PATENT DOCUMENTS

| | | |
|---|---|---|
| EP | 0758536 | 2/1997 |
| EP | 1010448 | 6/2000 |
| JP | 2001-340660 | 12/2001 |

* cited by examiner

*Primary Examiner* — Kien T Nguyen
(74) *Attorney, Agent, or Firm* — Holme Roberts & Owen LLP

(57) ABSTRACT

A sound producing play apparatus includes a support structure, an air compression system, a movable member, and a sound generating mechanism. In operation the air compression system harnesses energy from a user's movement of the movable member to create a forced supply of wind. The wind is then passed through a series of tubes and air reservoirs to a sound producing mechanism to create the desired sound. The air compression system includes an air compressor that is positioned inside a portion of the support structure to protect the air compressor from damage.

19 Claims, 5 Drawing Sheets

PLAY APPARATUS WITH INTEGRATED SOUND PRODUCING MECHANISM

CROSS-REFERENCE TO RELATED APPLICATIONS

This application claims the benefit of U.S. Provisional Application No. 60/974,442, filed Sep. 21, 2008 and entitled "Play Apparatus With Integrated Sound Producing Mechanism," which is incorporated herein by reference in its entirety.

BACKGROUND OF THE INVENTION

1. The Field of the Invention

The present invention relates to devices and equipment having moveable structures operable by the user to generate sounds, and more particularly to devices for play, exercise and recreational activity configured to produce sound when operated by the user.

2. The Relevant Technology

Playground, recreational, and exercise devices and equipment often involve the application of force by the user to produce motion. Examples such as see-saws, teeter-totters, swings, and manually operated merry-go-rounds, as well as exercise bicycles and rowing machines, are known.

BRIEF SUMMARY OF THE INVENTION

The invention is directed to interactive equipment for recreation, play and exercise that are configured to produce sound when the user operates the equipment. The equipment generally includes a support structure, an air compression system, a movable member, and a sound mechanism. In operation the air compression system of the apparatus harnesses energy from a user's movement of the movable member to create a forced supply of wind. The wind is then passed through a series of tubes to a sound producing mechanism to create the desired sound. The air compression system includes an air compressor that is positioned inside a portion of the support structure to protect the air compressor from damage.

Embodiments of the invention can be adapted to children's play apparatuses typically found in schoolyards, parks, and playgrounds and also found sometimes at home, for example a swing or teeter totter. The coordination of sound production with use of the apparatus adds interest and enjoyment and is believed to encourage physical activity.

Accordingly, a first example embodiment of the invention is a sound producing play apparatus. The sound producing play apparatus generally includes a support structure, an air compressor, a moveable member, a user support, compressor activation means, and a sound producing mechanism. The support structure has at least one support member positionable on a support surface, the support member having an interior space and the air compressor is positioned and protected within the interior space. The moveable member is configured for support by the support structure. The user support is mechanically associated with the moveable member, the user support being configured to support at least one user positioned thereon, the user support being configured and positioned on the moveable member for the user to apply a selected force to one of the moveable member, the support surface, and the support structure to urge the moveable member between a first position and a second position. The compressor activation means is in communication with the air compressor and the moveable member for converting the movement of the moveable member into activation of the air compressor to compress air. The sound producing mechanism is connected to one of the support structure, the user support, and the moveable member and configured to receive the compressed air and produce sound as the compressed air passes through the sound producing mechanism.

The air compressor is preferably a piston configured to compress air in the compressor when the moveable member is moved between a first position and a second position. The compressor activation means is preferably a rotatable cross bar connected to the movable member and to a lever arm, wherein the lever arm is connected to each of the rotatable cross bar and the air compressor, whereby movement of the moveable member between a first position and a second position turns the rotatable cross bar, thereby lifting and lowering the lever arm and operating the concealed air compressor.

In one embodiment the sound producing mechanism includes a sound tube having side walls forming an interior passageway for the flow of air therethrough, the side wall further defining at least one exit opening through which air exits the sound tube; and a languid or a reed, positioned in the interior passageway of the sound tube, proximate to the exit opening, to induce a selected sound on flow of air through the passageway. The sound tube preferably has a plurality of apertures, each aperture being formed to allow air flowing though the passageway to exit the tube and positioned for a user to cover at least one of the apertures to modify the pitch of the sound generated on passage of air through the exit opening.

The apparatus is preferably a swing where the support member includes a frame; the moveable member is a swing mechanism suspended from the frame; and the operated sound generator is mechanically associated with the swing mechanism, wherein a user positioned on the user support can apply force to move the swing mechanism and the movement of the swing mechanism causes the air operated sound generator to produce sound. In this embodiment the sound tube is a first hollow handle piece configured for being held by a first hand of a user while the user is supported by the user support and the movable member is in movement.

Another example embodiment of the invention is another sound generating apparatus. The apparatus includes a support structure having at least one support member positionable on a support surface, the support member having an interior space; and an air compressor positioned in the interior space. A moveable member is configured for support by the support structure and a rotatable member is connected to the support structure and the moveable member and configured to be rotatable in a first direction or a second direction by respective causal movement of the moveable member. Compressor activation means such as rotating cross arms, rotating members, lever arms, cables, chains, and the like are used for translating the movement of the rotatable member into activation of the air compressor to form an air supply. A user support mechanically associates with the moveable member, the user support being configured to support at least one user positioned thereon, the user support being configured and positioned on the moveable member for the user to apply a selected force to one of the moveable member, the support surface, and the support structure to urge the moveable member between the first position and the second position. A sound producing mechanism is connected to the moveable member to produce sound as the user support moves, the sound producing mechanism configured for receiving wind generated by the air compressor through one or more tubes and producing sound as the wind passes through the sound producing mechanism.

Another example embodiment of the invention is also a sound generating apparatus. The apparatus generally includes a support member, a moveable member, a user support, and an air operated sound generator. The support member is configured for support by one of a support surface and a support structure, the support member comprising an interior space. The moveable member is connected to the support member to be movable relative to the support member between a first position and a second position. The user support is mechanically associated with the moveable member, the user support being configured to support at least one user positioned thereon, the user support being configured and positioned on the moveable member for the user to apply a selected force to one of the moveable member, the support surface, the support structure and the support member to urge the moveable member between the first position and the second position. The air operated sound generator is configured to generate an air flow as the moveable member moves between the first position and the second position. The air operated sound generator includes: an air compressor positioned in the interior space of the support member and connected to the moveable member, the air compressor configured to receive and compress a volume of air upon movement of the moveable member; at least one closed tube, the at least one closed tube including side walls forming an interior passageway for flow of air therethrough, the side walls having at least one aperture through which air flows from the passageway to exit the tube; a connector connecting the air compressor to the at least one closed tube for transfer of the volume of air from the air compressor into the passageway of the tube; and a member selected from a languid and a reed, the member being positioned in the interior passageway of the tube to induce a sound on the flow of air through the passageway.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to the drawings to describe various aspects of exemplary embodiments of the invention. It is to be understood that the drawings are diagrammatic and schematic representations of such exemplary embodiments, and are not limiting of the present invention, nor are they necessarily drawn to scale.

In the following description, numerous specific details are set forth in order to provide a thorough understanding of the present invention. It will be obvious, however, to one skilled in the art that the present invention may be practiced without these specific details. In other instances, well-known aspects of playground equipment, air compression, and sound producing mechanisms have not been described in particular detail in order to avoid unnecessarily obscuring the present invention.

Figure 1:
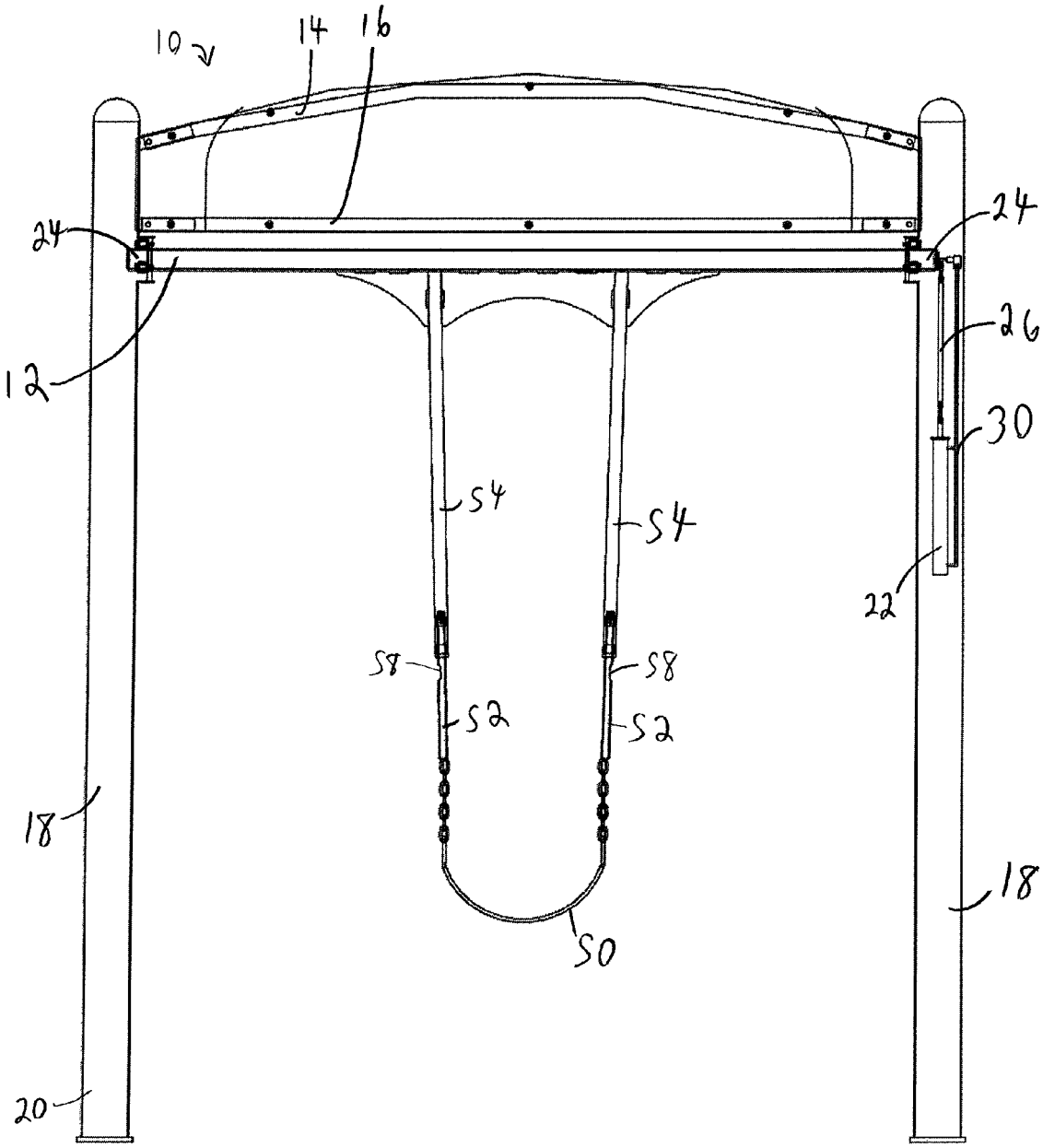
FIG. 1 is a sectional front view of an example embodiment of the invention.

An example embodiment of a sound producing play apparatus 10 is depicted in FIG. 1. The support structure of play apparatus 10 includes two support legs 18 with a rotatable cross bar 12 and two stationary cross bars 14, 16 connected to the legs 18. Each leg 18 is anchored at its bottom end 20 to a support surface such as a concrete pad or the ground and is also connected at its top end to stationary cross bars 14, 16 and rotatable cross bar 12. A suitable joint member 24 (e.g. including bearings) is used to connect the rotatable cross bar 12 to legs 18, thereby providing support for and permitting the necessary rotation of the rotatable cross bar 12. As is further described hereinbelow, at least one support leg 18 preferably has a sufficiently large interior spaces to enclose components of the sound producing mechanism and preferably store compressed air and transfer wind as necessary.

Figure 2:
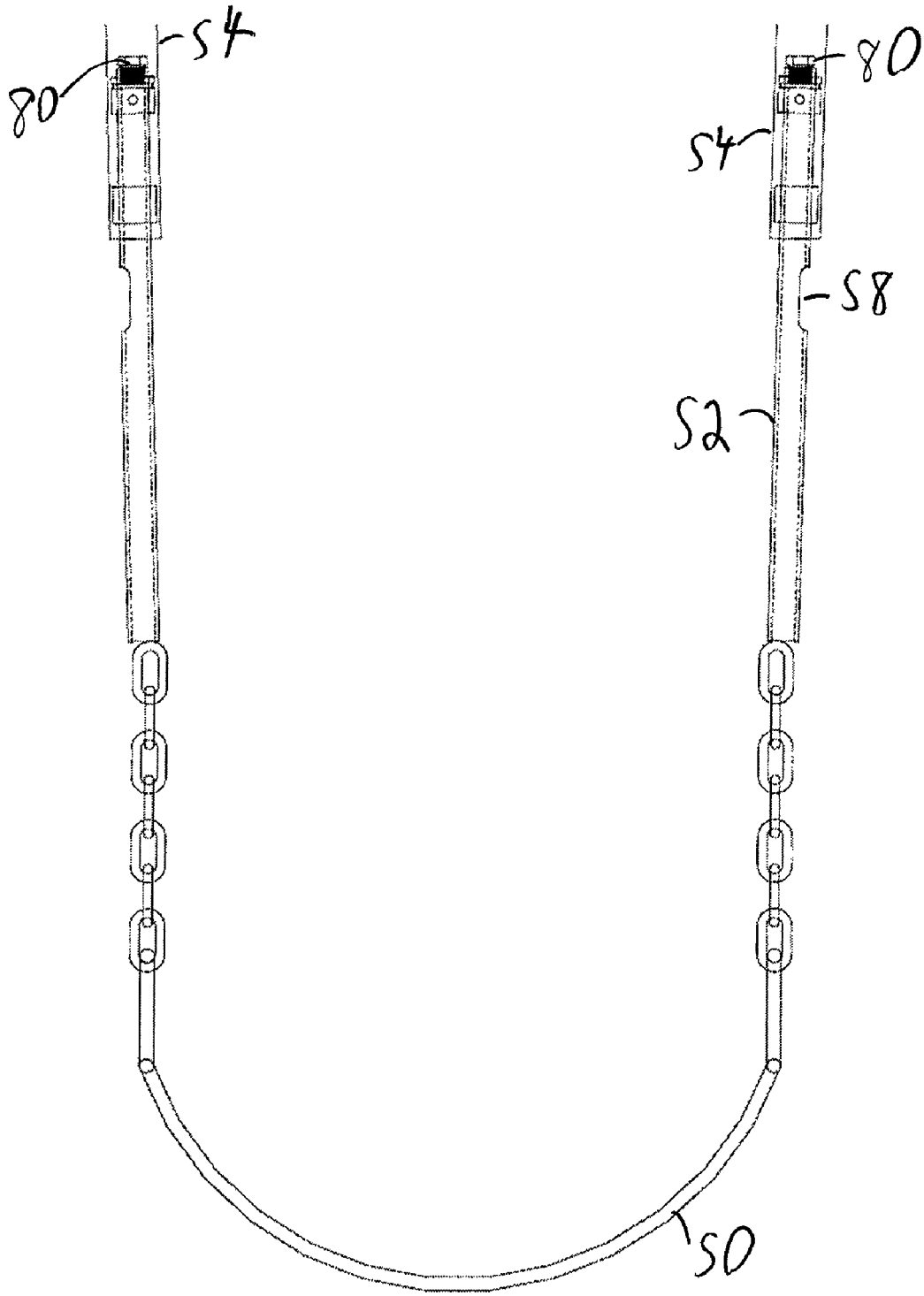
FIG. 2 is a sectional view of a portion of the embodiment of FIG. 1.

In the embodiment of FIG. 1 and as further illustrated in FIG. 2, the moveable member is a swing mechanism. In this embodiment the cross bar 12 forms part of the swing mechanism. The rotatable cross bar 12 is preferably formed as a hollow tube capable of transferring a forced supply of wind and supporting a user seated in the swing. Alternatively, the rotatable cross bar 12 may enclose or have attached thereto other wind transferring mechanisms.

The moveable member also includes a swing seat 50 to support a user. The swing seat 50 can be made in various forms, for example of a flexible material such as fabric, plastic or other elastomeric materials, or it can be rigid such as a flat seat or bucket seat. Connecting the seat 50 and the cross bar 12 are hollow handle pieces 52 and hollow arm pieces 54. The hollow handle pieces 52 are rigidly connected to the cross bar and the hollow arm pieces 54 are connected at one end to the hollow handle pieces 52 and at the other end to the seat 50 or connectors between the seat 50 and the hollow handle pieces 52. Each of the hollow arm pieces 54 and the hollow handle pieces 52 sustain the weight of a user as well as preferably conduct air therethrough via passageways in the interior of the tubing. Thus, hollow handle pieces 52 and hollow arm pieces 54 preferably permit the flow of air from the rotatable cross bar 12 to the handle pieces 52. The hollow handle pieces and/or the rotatable cross bar 12 may also function as an air reservoir(s) in certain embodiments.

In operation, as the user swings back and forth on the seat 50, hollow handle pieces 52 also move back and forth causing cross bar 12 to rotate back and forth. As previously mentioned, the play apparatus 10 further includes an air compression system that is an air operated sound generator configured to produce sound as air passes therethrough. The movement of the swing mechanism from at least a first position to a second position provides the energy for the generation of an air flow that in turn is utilized by the sound generator to produce sound.

Figure 3:
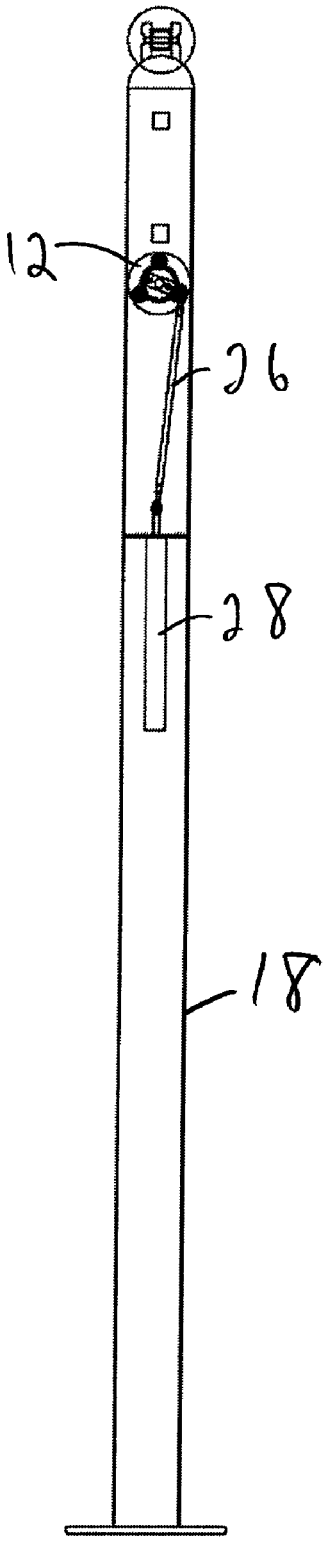
FIG. 3 is a side sectional view of another portion of the embodiment of FIG. 1.
Figure 4:
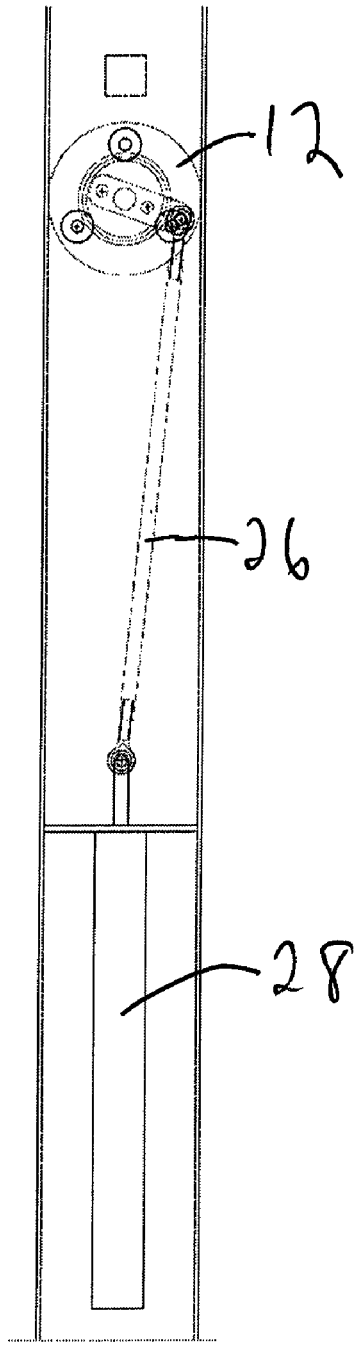
FIG. 4 is another side sectional view of a portion of the embodiment of FIG. 1.

As best seen in the side perspective views of FIGS. 3 and 4, one end portion of the cross bar 12 is connected to a compressor activation means for translating energy in the rotation of the cross bar to activation of the air compressor. Preferably, the air compressor 28 and the air compressor activation means are enclosed within a support member, e.g. support leg 18, of the support structure of the play apparatus 10. Concealing the air compressor is an elegant design that not only aids the aesthetics of the play apparatus 10, but also protects the air compressor 28 and related tubing from accidental or intentional damage from children's activities and the elements. Similarly, integrating the air reservoir into the tubing that conducts air from the air compressor and finally as wind to the sound producing mechanism also shields such structures from view and provides an internal reservoir to feed the sound generating system.

In this example the compressor activation means includes a compressor lever arm 26 connected to the perimeter of the end of the rotatable cross bar 12. Thus, as the cross bar 12 rotates, the lever arm 26 is raised and lowered. The movement of the lever arm 26 creates a pumping action in air compressor 28 and generates a flow of air. The air compressor can include a piston configured to compress air in the air compressor when the moveable member is moved between the first position and the second position. The proper selection of a manually activated air compressor such as air compressor 22 is readily apparent to those skilled in the art in view of the disclosure herein. Such air compressors can be obtained, for example, from the Bimba Manufacturing company in Monee, Ill.

The air flow exiting the compressor is conducted by one or more tubes (e.g., tubes 30 in leg 18, an air passage in cross bar 12, hollow handle pieces 52, and hollow arm pieces 54) to the sound producing mechanism. Some or all of the tubes can be constructed to serve as air reservoirs in addition to air conduits.

When a user operates the swing structure, the user is seated in the swing seat 50, and by pushing off from the ground and/or by extending and folding the user's legs, the user causes the swing seat 50, hollow handle pieces 52 and the hollow arm pieces 54 to move from at least a first position to a second position and correspondingly rotate the cross bar 12 from a first position to a second position. This movement, in turn, causes the lever arm to move and thus cause the air compressor 28 to pump air. The compressed air flows into the air reservoirs constructed as part of the play apparatus and eventually flows to the handle pieces 52 to produce sound as the air is directed across a sound producing mechanism. As will be appreciated, it is the user's swinging motion causes the sound producing mechanism to produce sound, thus providing an enhanced interaction experience.

Figure 5:
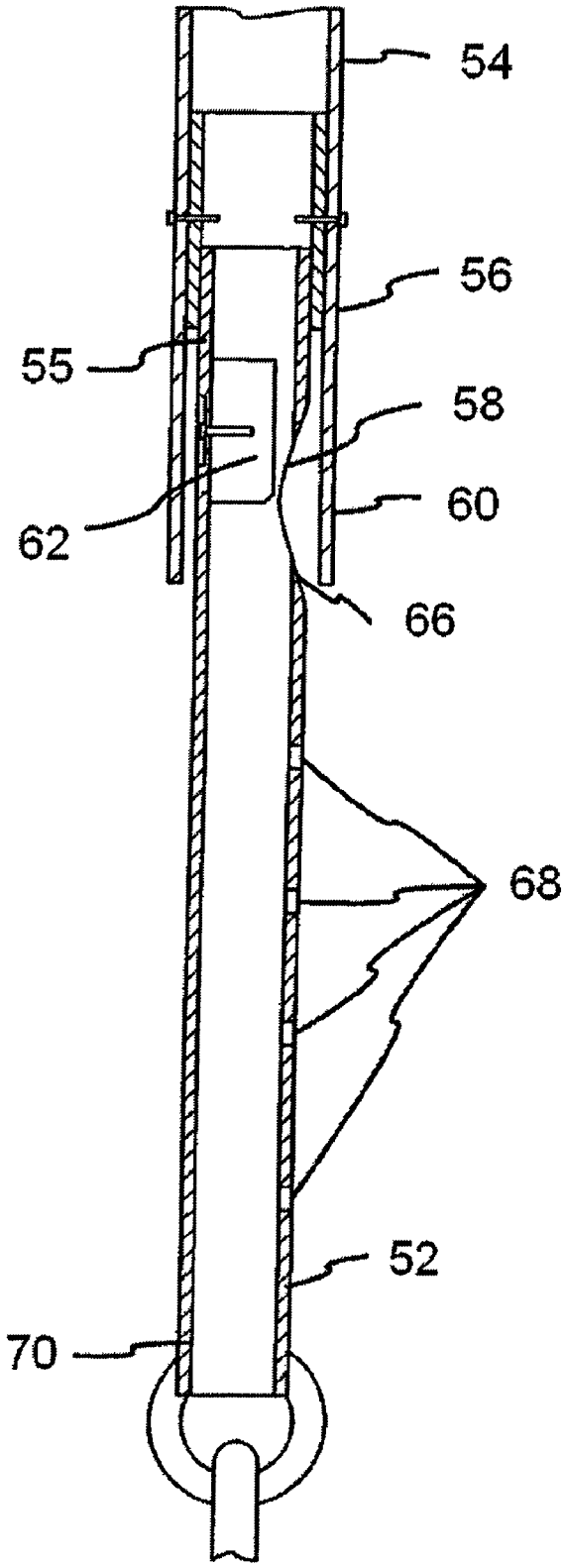
FIG. 5 illustrates a sound generating mechanism for use with embodiments of the invention.

One sound producing mechanism is illustrated in FIG. 5. In FIG. 5 the top end 55 of each of the handle pieces 52 is inserted into and connected to the bottom end 56 of each of the arm pieces 54, and an exit opening 58 is positioned in the top end 55 of each handle piece 52, which is covered by the lower wall 60 of the arm piece 54. A languid (also called a languet) 62, such as may be found in pipe organs, is positioned in each handle piece 52, over which air flowing down through the handle pieces 52 passes. The languid 62 blocks and narrows the flow of air into a thin sheet of air that then passes across the exit opening 58 proximate the languid 62, and against the lip 66 of the exit opening 58, setting up a vibration in the air within the handle pieces 52 that produces sound. In one alternative embodiment, one or more reed elements can be positioned in the handle pieces 52, or at another location in the sound producing mechanism, to produce a vibration and sound as air passes across the reed or reeds.

The apparatus can include pitch varying means included in one of the sound producing mechanism, the moveable member and the user support, controllable by the user for altering the pitch of the sound produced upon movement of the moveable member the sound producing mechanism. As will be appreciated, the handle pieces 52 can include one or more apertures 68 as are found in flutes or recorders, which can be covered by the fingers of the user to vary the pitch of the sound produced as air passes through the handle pieces 52. In one configuration, by covering the apertures 68 in a selected way, the user can thereby play a tune or a scale, or a pleasant series of tones, and so produce music as the user swings. The configuration of the sound generating structure can be varied utilizing apertures, reed elements, languids, or other structural elements to produce sound like that generated by any of various musical instruments such as a flute, recorder, clarinet, organ, pennywhistle, harmonica, or accordion. It should be noted that the handle pieces 52 can be open or closed at their bottom end 70.

The apparatus can also include a languid, positioned in the interior passageway of the tube, proximate to the aperture, to induce a selected sound on flow of air through the passageway. The tube can have a plurality of apertures each formed to allow air flowing though the passageway to exit the tube and positioned for a user to cover at least one of the apertures to modify the sound generated on movement of the moveable member. At least one reed can be positioned in the passageway of the tube to produce a selected sound as air flows through the passageway on movement of the moveable member. A plurality of tubes can be connected to the air compressor, each of the plurality of tubes including an interior passageway for flow of air therethrough, and each tube also having at least one of a reed, a languid, and an aperture in a selected position in the tube to produce a desired sound. A user can apply a first force to the apparatus to produce a first sound of a first pitch and apply a second force to produce a second sound of a second pitch. The apparatus can also be configured so that the user applies a plurality of forces to produce a plurality of different sounds simultaneously or in sequence.

Figure 6:
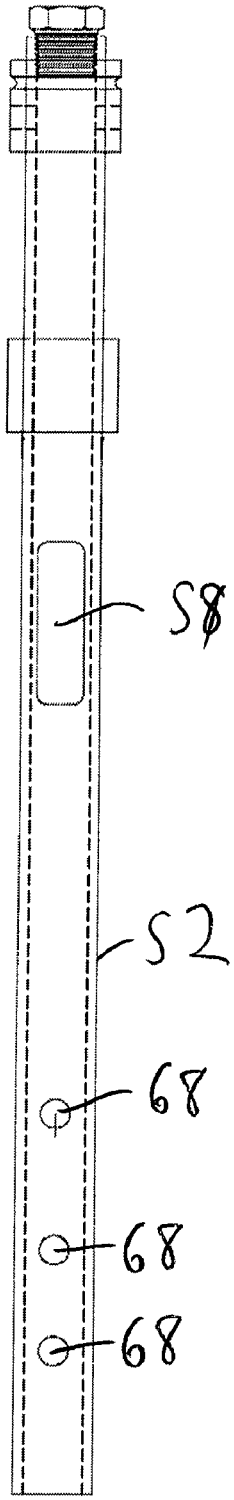
FIG. 6 illustrates a sound generating mechanism for use with embodiments of the invention.
Figure 7:
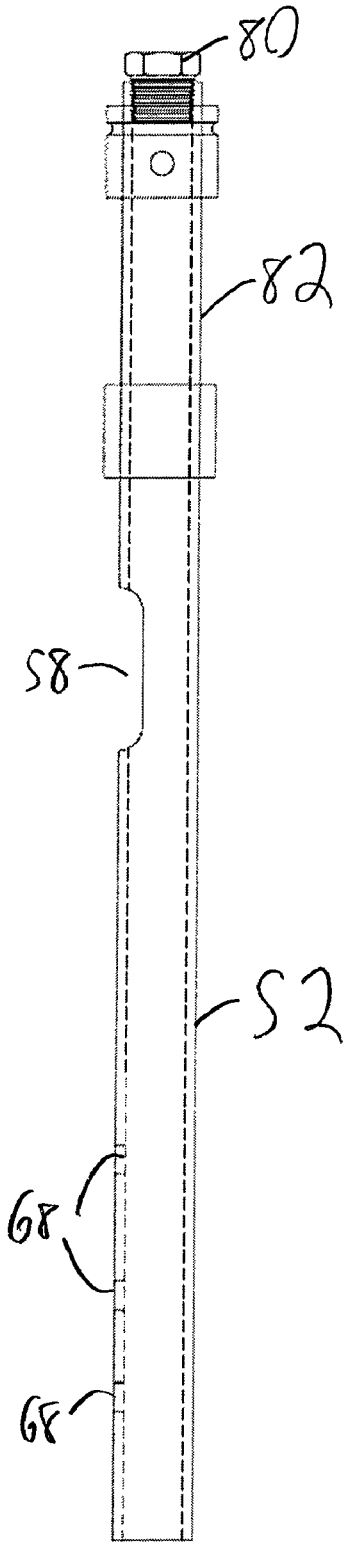
FIG. 7 illustrates a side view of the sound generating mechanism of FIG. 6.

With reference to FIGS. 6 and 7, another embodiment of the invention uses an aperture control 80 at the upper end 82 of handle pieces 52. The aperture control 80 helps maintain a steady flow of wind from cross bar 12 to handle pieces 52, and thus to the sound producing mechanism. A user's steady movement, or lack thereof, may also affect the flow rate of air, but the use of the aperture control can help steady the flow rate and improve the sound quality of the sound generating mechanism. As previously mentioned, this interactivity enhances the user's experience. Unlike the embodiment of FIG. 5, where the opening is at the junction of the arm pieces 54 and the handle pieces 52, In FIGS. 6 and 7 the opening is positioned in the center of the hollow handle 52.

Generally speaking, preferred sound producing mechanisms are organ-like in nature and use wind to produce the sound. Organ pipes are divided into two main families, according to their design and the kind of timbre that they consequently produce: flue pipes, which produce sound by forcing air through a fipple (like a recorder), and reed pipes, which contain a beating reed (like a clarinet). Although flue pipe style construction is preferred to avoid the use of moving parts, reed pipe construction may also be used.

A flue pipe (also referred to as a labial pipe) is an organ pipe that produces sound through the vibration of air molecules, in the same manner as a recorder or a whistle. Air under pressure (referred to as wind) is driven against a sharp lip called a flue, which causes the column of air in the pipe to vibrate. Thus, there are no moving parts in a flue pipe. This is in contrast to reed pipes, which are driven by a beating reed, similar to the clarinet. A typical flue pipe includes a pipe body or resonator, an upper lip, a languid, a lower lip, a foot, and a toe hole. Further details of organ pipes and their various parts are well known in the art and their selection and use in conjunction with the invention will be apparent to those skilled in the art.

Other devices for directing the flow of air and the nature of the produced sound can be utilized according to the invention. For example, structures similar to other wind instruments can be substituted. In one variation of this configuration, such as in organ-like instruments, there are several sound tubes with varying lengths and with sound apertures of varying size, and as released air is directed through selected but differently sized tubes, or multiple tubes at the same time, sounds of varying pitch are produced. In one configuration, a harmony is produced.

The apparatus can be configured to have a second moveable member, a second user support, and a second sound producing mechanism, the apparatus thus accommodating two users, and wherein each of the users applies a force to produce a selected sound.

Other play devices than a swing can incorporate various aspects of the invention. For example, a teeter totter can use a rotating axle that activates a hidden air compressor hidden in a support leg or arm of the a teeter totter. In this example, the air compressor can be position either in a support leg of the teeter totter or in a support arm of the teeter that extends towards a user of the teeter totter. The up and down movement of the teeter totter will rotate a center axle of the teeter totter, in turn depressing and raising an air compressor lever that generates air pressure in the compressor. One or more air reservoirs and tubes can be arranged to communicate the air to a sound producing mechanism elsewhere in the teeter totter. In a preferred example, a teeter totter can incorporate holes in the teeter totter handles that the user can cover with their fingers or hands to alter the sounds, similar to the handle mechanism described in the swing embodiments described above. Because there are two teeter totter users, placing air tubes and holes in handles at either end can allow the users to each make their own sounds as they attempt to form a harmony or tune while riding the teeter totter together.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sound producing play apparatus comprising:

a support structure having at least one support member positionable on a support surface, the support member having an interior space;

an air compressor positioned in the interior space;

a moveable member configured for support by the support structure;

a user support mechanically associated with the moveable member, the user support being configured to support at least one user positioned thereon, the user support being configured and positioned on the moveable member for the user to apply a selected force to one of the moveable member, the support surface, and the support structure to urge the moveable member between a first position and a second position;

compressor activation means in communication with the air compressor and the moveable member for converting the movement of the moveable member into activation of the air compressor to compress air; and a sound producing mechanism connected to one of the support structure, the user support, and the moveable member and configured to receive the compressed air and produce sound as the compressed air passes through the sound producing mechanism.

2. The apparatus of claim 1, wherein the air compressor comprises a piston configured to compress air in the compressor when the moveable member is moved between the first position and the second position.

3. The apparatus of claim 1, wherein the compressor activation means comprises a rotatable cross bar connected to the movable member and to a lever arm, wherein the lever arm is connected to each of the rotatable cross bar and the air compressor, whereby movement of the moveable member between a first position and a second position turns the rotatable cross bar, thereby lifting and lowering the lever arm and operating the air compressor.

4. The apparatus of claim 1, wherein the sound producing mechanism comprises:

a sound tube having side walls forming an interior passageway for the flow of air therethrough, the side wall further defining at least one exit opening through which air exits the sound tube; and a languid, positioned in the interior passageway of the sound tube, proximate to the exit opening, to induce a selected sound on flow of air through the passageway.

5. The apparatus of claim 4, wherein the sound tube comprises a first hollow handle piece configured for being held by a first hand of a user while the user is supported by the user support and the movable member is in movement.

6. The apparatus of claim 4, wherein the sound tube has a plurality of apertures, each aperture being formed to allow air flowing though the passageway to exit the tube and positioned for a user to cover at least one of the apertures to modify the pitch of the sound generated on passage of air through the exit opening.

7. The apparatus of claim 1, wherein the sound producing mechanism comprises:

a sound tube having an outer wall defining an interior passageway and an exit opening in the outer wall; and a reed positioned in the passageway of the sound tube to produce a selected sound as air compressed by the air compressor exits the sound tube through the exit opening.

8. The apparatus of claim 1, wherein:

the support member includes a frame;

the moveable member is a swing mechanism suspended from the frame; and the operated sound generator is mechanically associated with the swing mechanism, wherein a user positioned on the user support can apply force to move the swing mechanism and the movement of the swing mechanism causes the air operated sound generator to produce sound.

9. The apparatus of claim 1, further comprising a second moveable member, a second user support, and a second air operated sound generator, the apparatus accommodating two users, and wherein each of the users applies a force to produce a selected sound.

10. A sound producing play apparatus comprising:

a support structure having at least one support member positionable on a support surface, the support member having an interior space;

an air compressor positioned in the interior space;

a moveable member configured for support by the support structure;

a rotatable member connected to the support structure and the moveable member and configured to be rotatable in a first direction or a second direction by respective causal movement of the moveable member;

compressor activation means for translating the movement of the rotatable member into activation of the air compressor to form an air supply;

a user support mechanically associated with the moveable member, the user support being configured to support at least one user positioned thereon, the user support being configured and positioned on the moveable member for the user to apply a selected force to one of the moveable member, the support surface, and the support structure to urge the moveable member between the first position and the second position; and a sound producing mechanism connected to the moveable member to produce sound as the user support moves, the sound producing mechanism configured for receiving wind generated by the air compressor through one or more tubes and producing sound as the wind passes through the sound producing mechanism.

11. The apparatus of claim 10, wherein the air compressor comprises a piston configured to compress air in the compressor when the moveable member is moved between the first position and the second position.

12. The apparatus of claim 10, wherein the sound producing mechanism comprises:

a sound tube having side walls forming an interior passageway for the flow of air therethrough, the side wall further defining at least one exit opening through which air exits the sound tube; and a languid, positioned in the interior passageway of the sound tube, proximate to the exit opening, to induce a selected sound on flow of air through the passageway.

13. The apparatus of claim 12, wherein the sound tube has a plurality of apertures, each aperture being formed to allow air flowing though the passageway to exit the tube and positioned for a user to cover at least one of the apertures to modify the pitch of the sound generated on passage of air through the exit opening.

14. The apparatus of claim 10, wherein the sound producing mechanism comprises:

a sound tube having an outer wall defining an interior passageway and an exit opening in the outer wall; and a reed positioned in the passageway of the sound tube to produce a selected sound as air compressed by the air compressor exits the sound tube through the exit opening.

15. The apparatus of claim 14, wherein the first sound tube further comprises a first hollow handle piece configured for being held by a first hand of a user while the user is supported by the user support and the movable member is in movement.

16. An apparatus comprising:

a support member configured for support by one of a support surface and a support structure, the support member comprising an interior space;

a moveable member connected to the support member to be movable relative to the support member between a first position and a second position;

a user support mechanically associated with the moveable member, the user support being configured to support at least one user positioned thereon, the user support being configured and positioned on the moveable member for the user to apply a selected force to one of the moveable member, the support surface, the support structure and the support member to urge the moveable member between the first position and the second position; and, an air operated sound generator that includes:

an air compressor positioned in the interior space of the support member and connected to the moveable member;

a rotatable cross bar connected to the movable member and to a lever arm, the lever arm being connected to each of the rotatable cross bar and the air compressor, whereby movement of the moveable member between the first position and the second position turns the rotatable cross bar, thereby lifting and lowering the lever arm and operating the air compressor to receive and compress a volume of air;

at least one closed tube, the at least one closed tube including side walls forming an interior passageway for flow of air therethrough, the side walls having at least one aperture through which air flows from the passageway to exit the tube;

a connector connecting the air compressor to the at least one closed tube for transfer of the volume of air from the air compressor into the passageway of the tube; and, a member selected from a languid and a reed, the member being positioned in the interior passageway of the tube to induce a sound on the flow of air through the passageway.

17. The apparatus of claim 16, wherein the air compressor comprises a piston configured to compress air in the compressor when the moveable member is moved between the first position and the second position.

18. The apparatus of claim 16, wherein the at least one closed tube comprises a first hollow handle piece configured for being held by a first hand of a user while the user is supported by the user support and the movable member is in movement.

19. The apparatus of claim 16, wherein:

the support member includes a frame;

the moveable member is a swing mechanism suspended from the frame; and the air operated sound generator is mechanically associated with the swing mechanism, wherein a user positioned on the user support can apply force to move the swing mechanism and the movement of the swing mechanism causes the air operated sound generator to produce sound.

* * * * *